US008162154B2

(12) United States Patent
Trulaske, Sr.

(10) Patent No.: US 8,162,154 B2
(45) Date of Patent: Apr. 24, 2012

(54) SHELF ORGANIZER WITH GLIDE STRIP

(75) Inventor: Steven L. Trulaske, Sr., St. Louis, MO (US)

(73) Assignee: True Manufacturing Co., Inc., O'Fallon, MO (US)

( * ) Notice: Subject to any disclaimer, the term of this patent is extended or adjusted under 35 U.S.C. 154(b) by 309 days.

(21) Appl. No.: 12/578,068

(22) Filed: Oct. 13, 2009

(65) Prior Publication Data

US 2010/0072149 A1 Mar. 25, 2010

Related U.S. Application Data

(63) Continuation-in-part of application No. 11/563,994, filed on Nov. 28, 2006.

(51) Int. Cl.
*A47F 1/04* (2006.01)

(52) U.S. Cl. ..... 211/59.2; 211/183

(58) Field of Classification Search ..... 211/59.2, 211/59.3, 74, 90.01, 153, 183, 184; 312/35, 312/42, 45, 60, 61, 71, 72, 73; 108/60, 61; 248/223.41, 224.51

See application file for complete search history.

(56) References Cited

U.S. PATENT DOCUMENTS

| | | | | |
|---|---|---|---|---|
| 2,218,444 | A | 10/1940 | Vineyard | |
| 2,572,090 | A | 10/1951 | Allen | |
| 3,104,137 | A | 9/1963 | Cohen | |
| 3,320,011 | A * | 5/1967 | Sachnoff et al. | 312/351 |
| 3,454,168 | A * | 7/1969 | Cahn | 211/134 |
| 3,484,226 | A | 12/1969 | Golightly | |
| 3,545,624 | A * | 12/1970 | Krikorian | 211/126.15 |
| 3,780,873 | A | 12/1973 | Silva | |
| 3,894,634 | A | 7/1975 | Gotham et al. | |
| 3,905,484 | A | 9/1975 | Dean et al. | |
| 3,986,780 | A | 10/1976 | Nivet | |
| 3,990,375 | A | 11/1976 | Adams | |
| 4,106,668 | A | 8/1978 | Gebhardt et al. | |
| 4,191,296 | A | 3/1980 | Morgan | |
| 4,205,763 | A | 6/1980 | Merl | |
| 4,228,903 | A | 10/1980 | Eckert | |

(Continued)

FOREIGN PATENT DOCUMENTS

| | | |
|---|---|---|
| DE | 931276 | 11/1994 |

(Continued)

OTHER PUBLICATIONS

PCT/US2007/084790, International Preliminary Report on Patentability, Jun. 5, 2008.

*Primary Examiner* — Darnell Jayne
*Assistant Examiner* — Joshua Rodden
(74) *Attorney, Agent, or Firm* — Polster Lieder Woodruff & Lucchesi, L.C.

(57) ABSTRACT

A gravity feed dispenser (50) for containers, in which the dispenser (50) carrying the containers includes a pair of longitudinally extending stringers (80) engaging with shelf rack (20) in snap-fitting relation to secure the dispenser (50) to the rack (20). In another embodiment, the dispenser (50) has sidewalls (52) of transparent plastic for product visibility and is provided with a glide strip (100) which is attached to the floor (54) of the dispenser (50) by hooks (102) temporarily, and permanently by fusion of the glide strip (100) to the dispenser (50) as by sonic welding.

7 Claims, 8 Drawing Sheets

U.S. PATENT DOCUMENTS

RE30,706 E 8/1981 Bustos
4,331,237 A 5/1982 Edell
4,395,955 A 8/1983 Pfeifer
4,416,380 A * 11/1983 Flum ..... 211/59.2
4,460,096 A 7/1984 Ricci
4,478,337 A * 10/1984 Flum ..... 211/59.2
4,488,653 A 12/1984 Belokin
D277,154 S 1/1985 Nasgowitz
4,538,737 A 9/1985 Delaney
4,552,272 A 11/1985 Field
4,565,725 A * 1/1986 Spamer et al. ..... 428/167
4,598,828 A 7/1986 Young et al.
4,618,063 A 10/1986 Mendenhall
4,685,574 A 8/1987 Young et al.
4,690,287 A 9/1987 Fershko et al.
4,694,966 A 9/1987 Sorenson et al.
4,712,694 A 12/1987 Breslow
4,724,968 A 2/1988 Wombacher
4,730,741 A 3/1988 Jackle, III et al.
4,744,489 A * 5/1988 Binder et al. ..... 221/6
4,762,236 A 8/1988 Jackle, III et al.
4,763,796 A 8/1988 Flum
4,785,943 A 11/1988 Deffner et al.
4,785,945 A * 11/1988 Rowse et al. ..... 211/59.2
4,801,025 A 1/1989 Flum et al.
4,836,390 A 6/1989 Polvere
4,890,746 A 1/1990 Trulaske, Sr.
4,907,707 A 3/1990 Crum
4,923,070 A 5/1990 Jackle et al.
4,942,967 A 7/1990 Schneider
4,942,968 A 7/1990 Fast
4,947,999 A * 8/1990 Warp ..... 211/183
4,953,719 A 9/1990 Spamer
4,955,486 A * 9/1990 Trulaske, Sr. ..... 211/59.2
4,960,210 A 10/1990 Spamer
4,997,094 A 3/1991 Spamer et al.
5,012,936 A 5/1991 Crum
D317,382 S 6/1991 Polvere
5,022,535 A * 6/1991 Spamer ..... 211/59.2
5,024,336 A 6/1991 Spamer
5,050,748 A 9/1991 Taub
5,069,349 A 12/1991 Wear et al.
5,076,443 A * 12/1991 Trulaske, Sr. ..... 211/59.2
5,097,962 A 3/1992 Eklof et al.
5,119,945 A 6/1992 Wiggins
5,131,563 A 7/1992 Yablans
5,154,299 A 10/1992 Hwang
5,205,421 A 4/1993 Bustos
5,232,102 A 8/1993 Ozawa
5,240,126 A 8/1993 Foster et al.
5,265,738 A 11/1993 Yablans et al.
5,351,838 A 10/1994 Flum
5,366,099 A 11/1994 Schmid
5,417,333 A 5/1995 Flum
5,450,968 A 9/1995 Bustos
5,458,248 A 10/1995 Alain
5,531,336 A 7/1996 Parham et al.
5,538,147 A * 7/1996 Fucci ..... 211/153
D372,381 S 8/1996 Goldring et al.
5,562,217 A 10/1996 Salveson et al.
5,614,288 A * 3/1997 Bustos ..... 428/167
5,624,042 A 4/1997 Flum et al.
5,634,564 A 6/1997 Spamer et al.
5,645,176 A 7/1997 Jay
5,695,076 A * 12/1997 Jay ..... 211/59.2
5,695,077 A 12/1997 Jay
5,788,090 A 8/1998 Kajiwara
D401,436 S 11/1998 Jay
5,862,923 A * 1/1999 Nordquist et al. ..... 211/59.2
5,865,323 A * 2/1999 Lecroy ..... 211/59.2
5,868,262 A * 2/1999 Carson ..... 211/59.2
5,992,650 A * 11/1999 Lord ..... 211/59.2
6,105,791 A * 8/2000 Chalson et al. ..... 211/59.3
6,135,297 A * 10/2000 DeShazo et al. ..... 211/74
6,142,316 A 11/2000 Harbour et al.
6,273,276 B1 8/2001 Upton
D448,589 S 10/2001 Trulaske, Sr.
6,328,170 B1 12/2001 Lee
6,401,945 B1 * 6/2002 Gawel ..... 211/183
6,659,293 B1 * 12/2003 Smith ..... 211/59.2
6,672,464 B2 * 1/2004 Robertson ..... 211/59.2
6,715,621 B2 * 4/2004 Boron ..... 211/59.2
6,739,461 B1 * 5/2004 Robinson ..... 211/59.2
7,131,547 B2 * 11/2006 Gawel ..... 211/183
D552,877 S * 10/2007 Trulaske, Sr. et al. ..... D6/408
7,823,734 B2 * 11/2010 Hardy ..... 211/59.3
7,823,749 B2 * 11/2010 Kelly ..... 221/178
2001/0045402 A1 * 11/2001 Hawley ..... 211/59.2
2002/0162814 A1 * 11/2002 Gawel ..... 211/183
2005/0067429 A1 * 3/2005 Halbherr ..... 221/192
2006/0032827 A1 * 2/2006 Phoy ..... 211/59.2
2007/0119798 A1 * 5/2007 Hanretty ..... 211/59.2
2007/0119799 A1 * 5/2007 Hanretty et al. ..... 211/59.2
2008/0121595 A1 * 5/2008 Trulaske ..... 211/59.2

FOREIGN PATENT DOCUMENTS

DE 20113198 6/2002
GB 2020197 3/1980

* cited by examiner

SHELF ORGANIZER WITH GLIDE STRIP

CROSS-REFERENCE TO RELATED APPLICATIONS

This application is related to U.S. patent application Ser. No. 11/563,994 filed Nov. 28, 2006 from which priority is claimed, and is hereby incorporated by reference.

STATEMENT REGARDING FEDERALLY SPONSORED RESEARCH

Not Applicable.

BACKGROUND OF THE INVENTION

This invention relates generally to container dispensers for refrigerators and particularly to a plurality of gravity feed dispensers which are snap-fitted to a merchandiser rack. The prior art includes U.S. Pat. No. 4,890,746 issued to True Manufacturing Co, Inc. of St. Louis, Mo.

The invention also relates to a transparent container dispenser for product visibility and to a glide strip which is initially temporarily attached to the container dispenser and finally permanently attached to the dispenser.

SUMMARY OF THE INVENTION

This invention comprises a gravity feed container dispenser in which the dispenser provides longitudinally extending ribs on the defining attachments means engaging the rails of the shelf rack in snap-fitted relation to hold the dispenser in place.

It is an aspect of this invention to provide an open top container dispenser having spaced apart sidewalls to retain the containers.

An additional aspect of the invention relates to the provision of a glide strip attached to the floor of the dispenser to provide a superior sliding surface for the product delivery, the glide strip is initially temporarily attached to the container dispenser by hooks and finally permanently attached to the dispenser by sonic welding. It is another aspect of the invention to provide that at least the sidewalls of the dispenser are transparent to provide for product visibility.

DESCRIPTION OF THE PREFERRED EMBODIMENT

Figure 1:
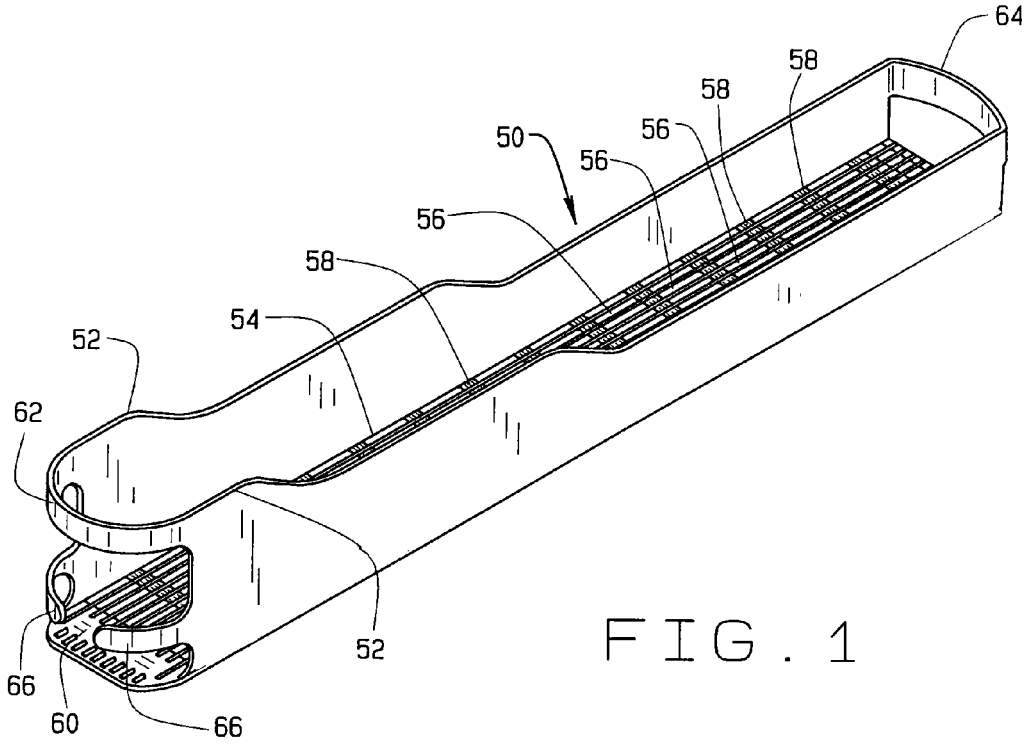
FIG. 1 is a perspective view of the container dispenser.
Figure 2:
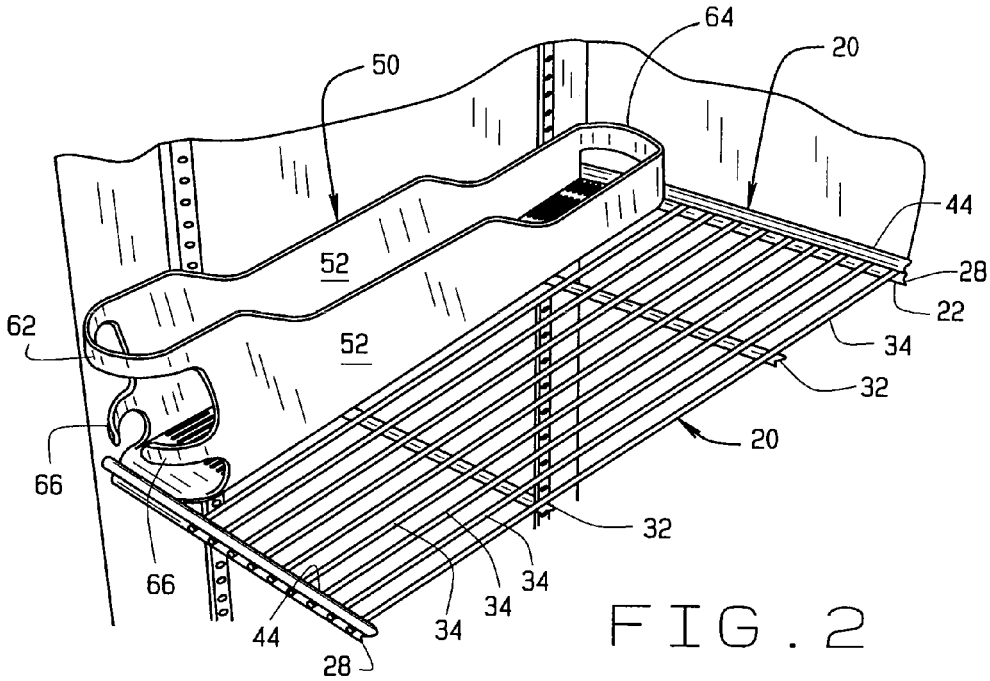
FIG. 2 is a view of the dispenser snap fitted onto a shelf rack.

This shelf organizer consists essentially of a rack 20 formed from a generally rectangular frame 22 having opposed side members 24 and front and rear members 28 and lateral intermediate support members 32 extending between the side members 24 in generally parallel relation to said front and rear members 28. The rack 20 also includes a plurality of longitudinally extending rails 34 and front and rear upper stop members 44 lying on the rails 34 and providing stop members above the front and rear members 28, respectively. The rack 20 is preferably integrally formed by welding and is held in an inclined position, sloping downwardly from the rear end by clip supports 40. The profile of the refrigerator is shown by numeral 10.

The rack 20 provides container dispensers 50, preferably of plastic, which, in the embodiment shown, seats on the rack rails 34. The dispenser 50 in the preferred embodiment is preferably molded from plastic and includes opposed sidewalls 52 connected by a floor 54. The floor 54 includes a plurality of longitudinal stringers 56 extending substantially from top to bottom of the dispenser 50, and a plurality of connecting lateral stringers 58 which extend substantially from side to side of said dispenser. At its front end the retainer includes a short floor portion 60 integrally formed with the longitudinal stringers 56. The sidewalls 52 are of diminishing height rearwardly and are connected by arcuate strap members 62 and 64 at its front and rear ends respectively. At its front end, intermediate the strap member 62 and the floor portion 54, are opposed, arcuately formed strap members 66 which are not connected.

The rack 20 may be seated on the clips 40 such that an inclined upper plane is formed from the upper surface of the rails 34. Typically, the inclined upper plane will be at about 5 to 10 degrees which is sufficient to provide an equally sloping floor for the container dispensers 50.

Figure 3:
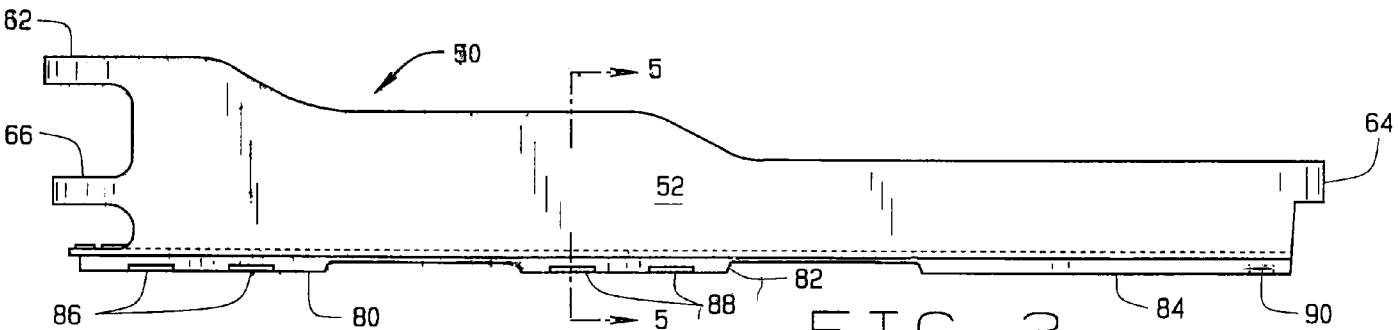
FIG. 3 is an elevational view of the dispenser.

Importantly, each dispenser 50 is removably attached to the rack 20 so that the dispensers can be removed to accommodate different sized containers. To this end the container dispenser 50 includes opposed longitudinally extending stringers 80, 82 and 84 at intervals constituting attachment means which depend below the floor member and are spaced to engage the rails 34 in snap-fitted relation. As shown in FIG. 3 and in FIG. 5 each stringer 82 is spaced from its cooperating stringer 82 and includes a turned-in end 88 to facilitate the snap-fitting action.

Preferably, the rails 34 are equally spaced across width of the rack 20. Ideally, the distance between the outside faces of the stringers 82 is equal to the distance between the inside faces of the adjacent rail 34. With this arrangement the distance between the in-turned portions 86, 88 and 90 of the stringers 80, 82 and 84, respectively, is slightly greater than that of the engaged rail 34 so that it is sprung below the rail 34 into overlapping engagement with the rail.

Figure 9:
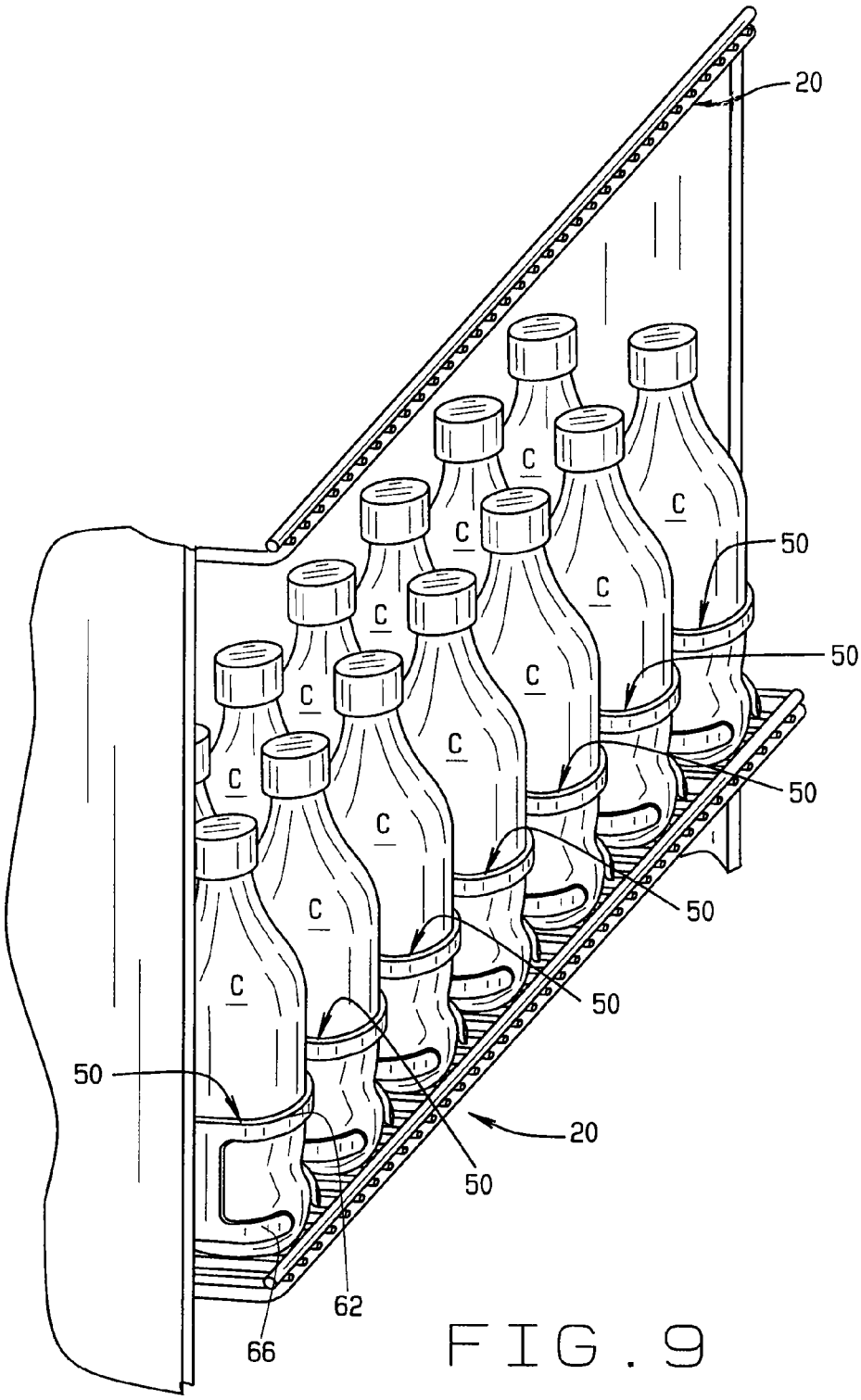
FIG. 9 is a perspective view showing the shelf rack loaded with bottle containers.
Figure 10:
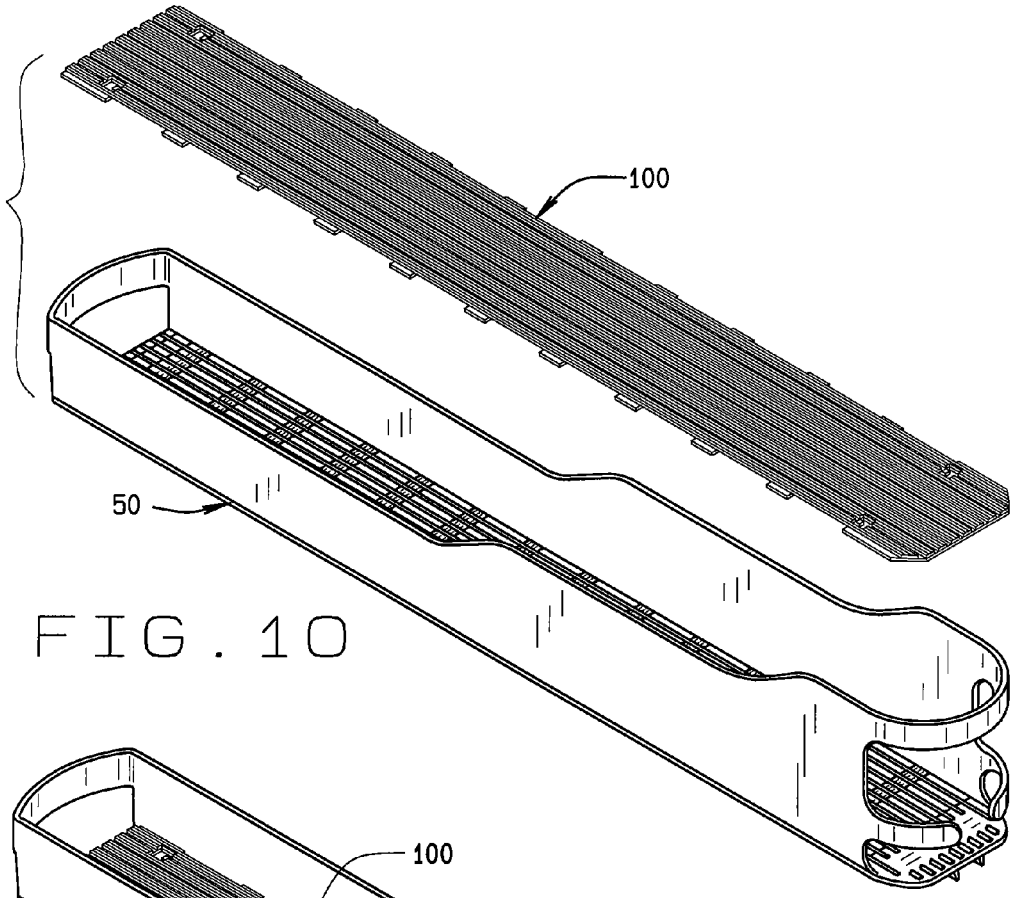
FIG. 10 is a perspective view of the container dispenser prior to installation of the glide strip.
Figure 11:
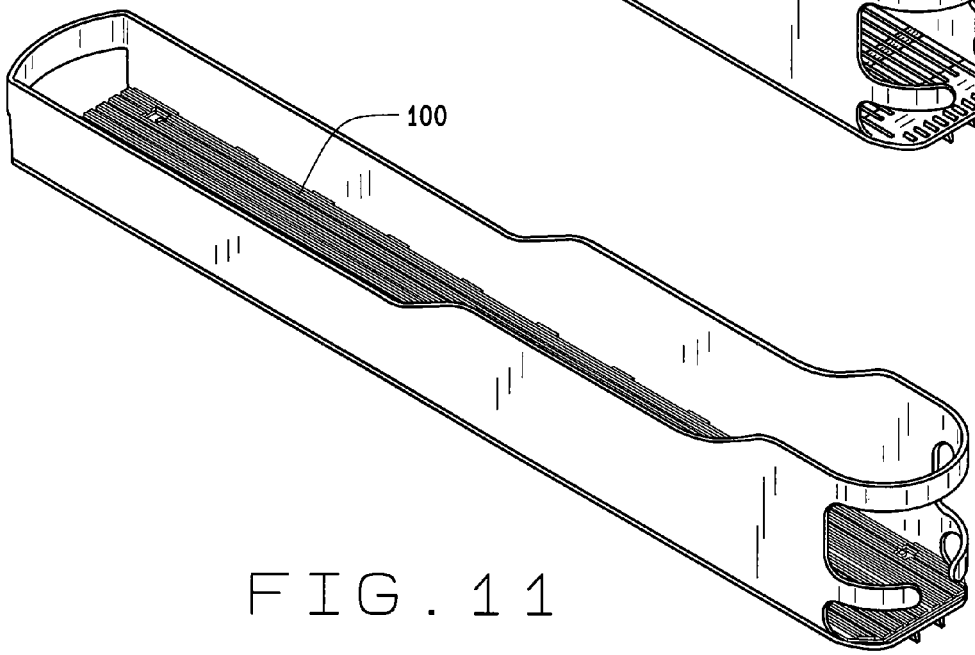
FIG. 11 is a perspective view of the container dispenser following installation of the glide strip.

The configuration of the in-turned portion 88 of the finger, constituting upset stringer portions, is such that the retainer 50 is readily removed and replaced and yet is firmly held in position on the rack. Although bottle containers C is shown in FIG. 9, it will be understood that the container dispenser can also accept cans or other packages.

Typically, the dispenser containers 50 are held in side-by-side relation touching, or almost touching, and the containers are slidingly received on the floor so as to be gravity fed on said floor with the angle of inclination of the container dispenser floor being adjusted by virtue of the clips 40. The containers C, which are shown in FIG. 9, are received within the dispensers 50 for easy removal and the dispensers themselves are readily removed as by pulling upwardly on the straps 62.

Figure 4:
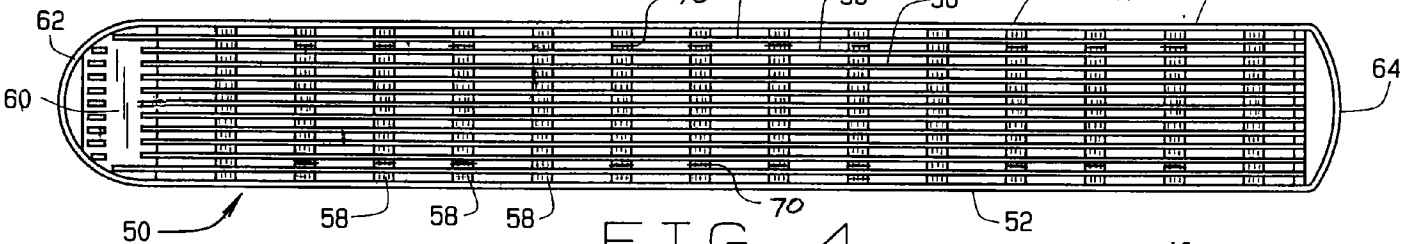
FIG. 4 is a plan view of the dispenser.
Figure 5:
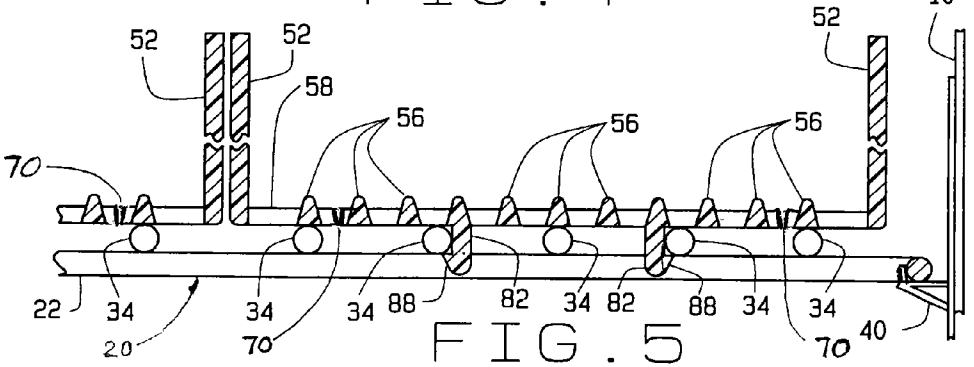
FIG. 5 is an enlarged view of the dispenser snap-fittingly engaged with the shelf rack.
Figure 6:
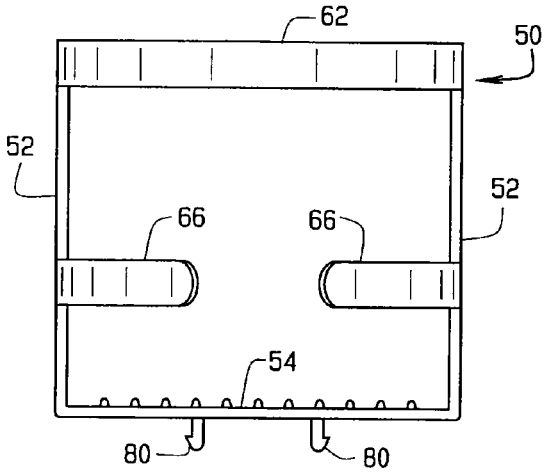
FIG. 6 is a front view of the dispenser.
Figure 7:
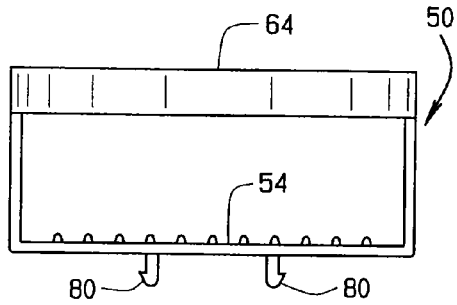
FIG. 7 is a rear view of the dispenser.
Figure 8:
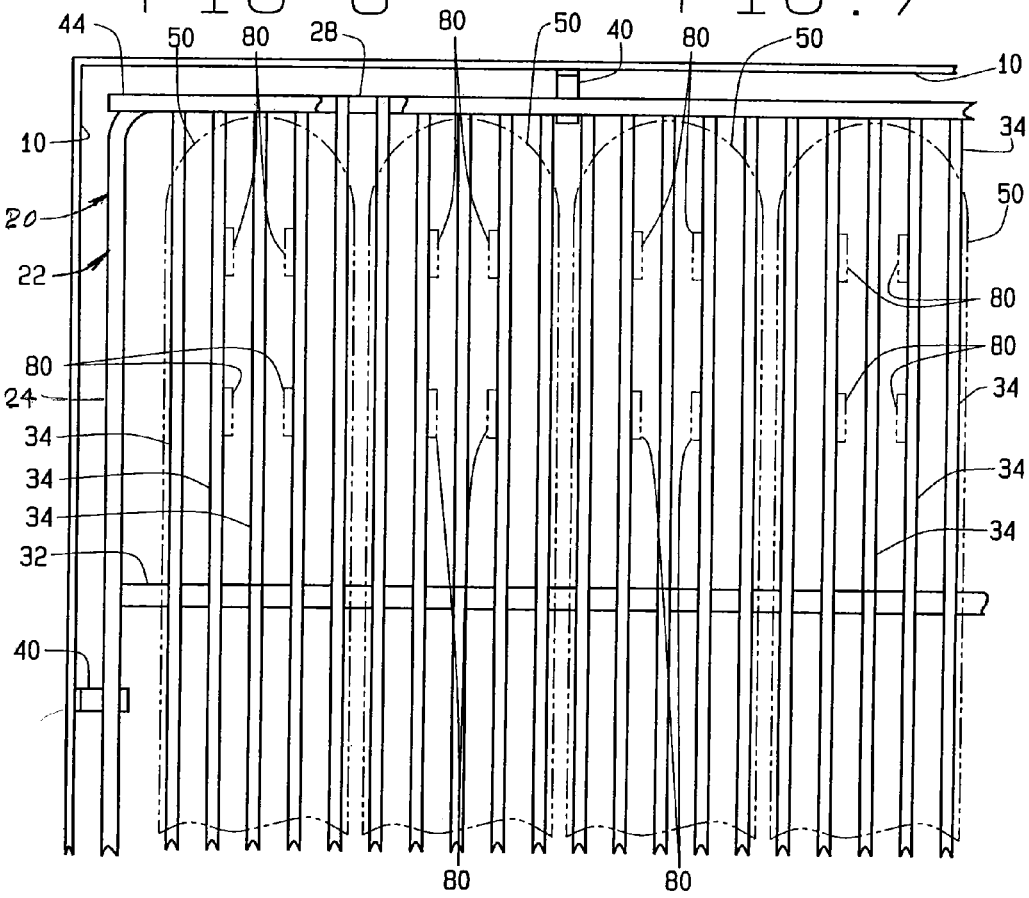
FIG. 8 is a plan view of the shelf rack with the dispensers shown in the phantom outline

As shown in FIGS. 4 and 5 the lateral stringers 58 between the first and second rails from each side 52 include tapered relief slits 70. These relief slits 70 are spaced to permit the sides of the containers to move, to suit different diameter containers, yet maintain rigidity between the lateral stringers, in the vicinity of the attachment means.

Also, the structure of the containers readily permits the length and width thereof to be adapted to suit the size of the cooler with which they are used by adjustment of the size and spacing of the lateral stringers.

A second embodiment is shown in FIGS. 10-18 which has two distinctive features over the first embodiment. The first feature is the provision a glide strip 100 formed preferably of an essentially opaque material which is installed onto the container dispenser 50, in attached relation. To this end, the glide strip 100 includes a plurality of hooks 102 which depend through openings 103 provided between the longitudinal stringers 56 and project below the longitudinal stringers to hook onto front and rear portions and selected lateral stringers. The second feature is that at least the dispenser sidewalls are formed from transparent material for product visibility.

Figure 12:
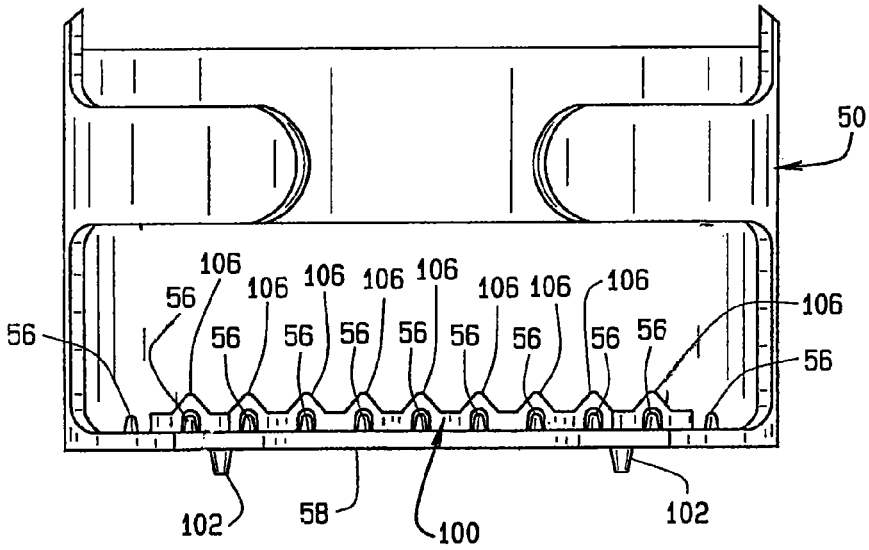
FIG. 12 is an enlarged front end view of the glide strip and container dispenser with the glide strip installed showing the hook connection but omitting the snap-connection of the container to the rack.

It will be understood that the transparent dispensers 50 are identical to the non-transparent dispensers except for the important transparency distinction of the sidewall transparency and the fact that they have the fitted glide strip 100. The glide strip 100 is provided with corrugations 106 and each corrugation 106 overfits a longitudinal stringer 56, such that the glide strip 100 intermediate portions 104 form a lateral stringers 108 which seat generally on the container dispenser lateral stringers 58. As shown in FIG. 12 the number of corrugations 106 in the embodiment shown is two less than the number of stringers 56 so that the extreme side stringers 56 provide a useful guide in fitting the glide strip 100 to the container dispenser.

Figure 13:
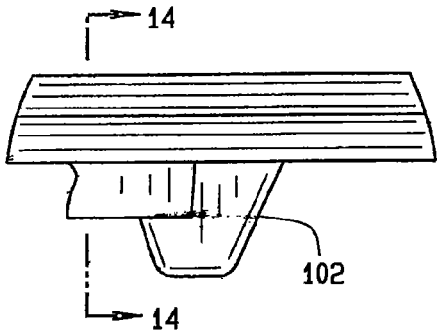
FIG. 13 is an enlarged fragmentary view of the hook connection.
Figure 14:
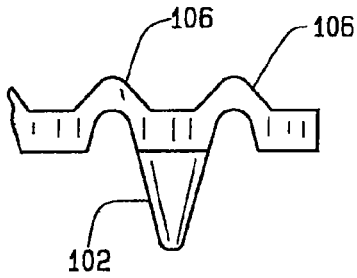
FIG. 14 is an enlarged view taken on line 14-14 of FIG. 13.
Figure 15:
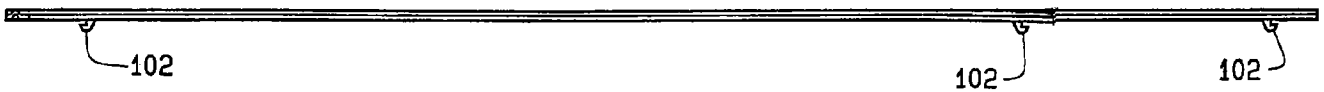
FIG. 15 is an elevational view of the glide strip.
Figure 16:
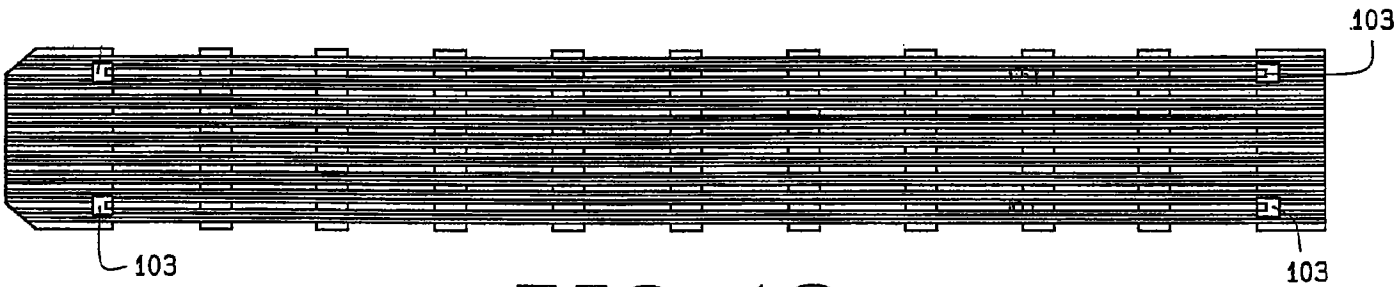
FIG. 16 is a top plan view of the glide strip showing the location of the hooks.
Figure 17:
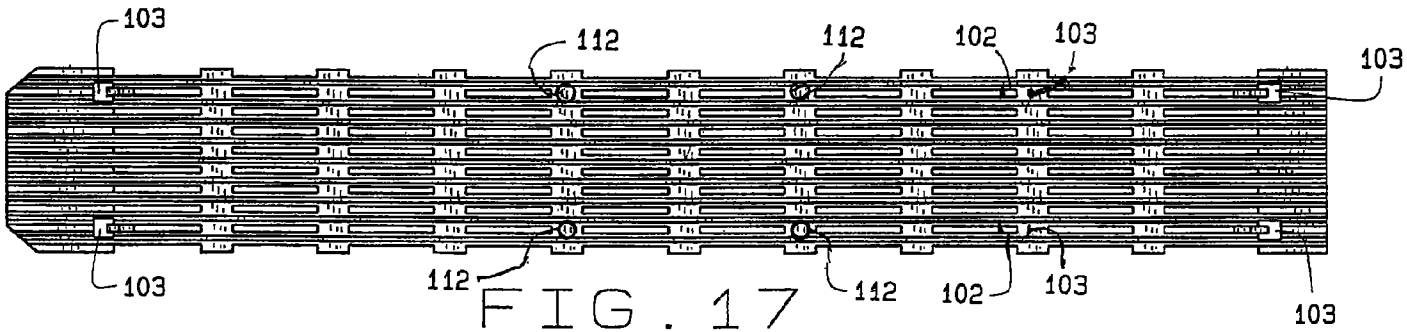
FIG. 17 is a bottom plan of the glide strip.
Figure 18:
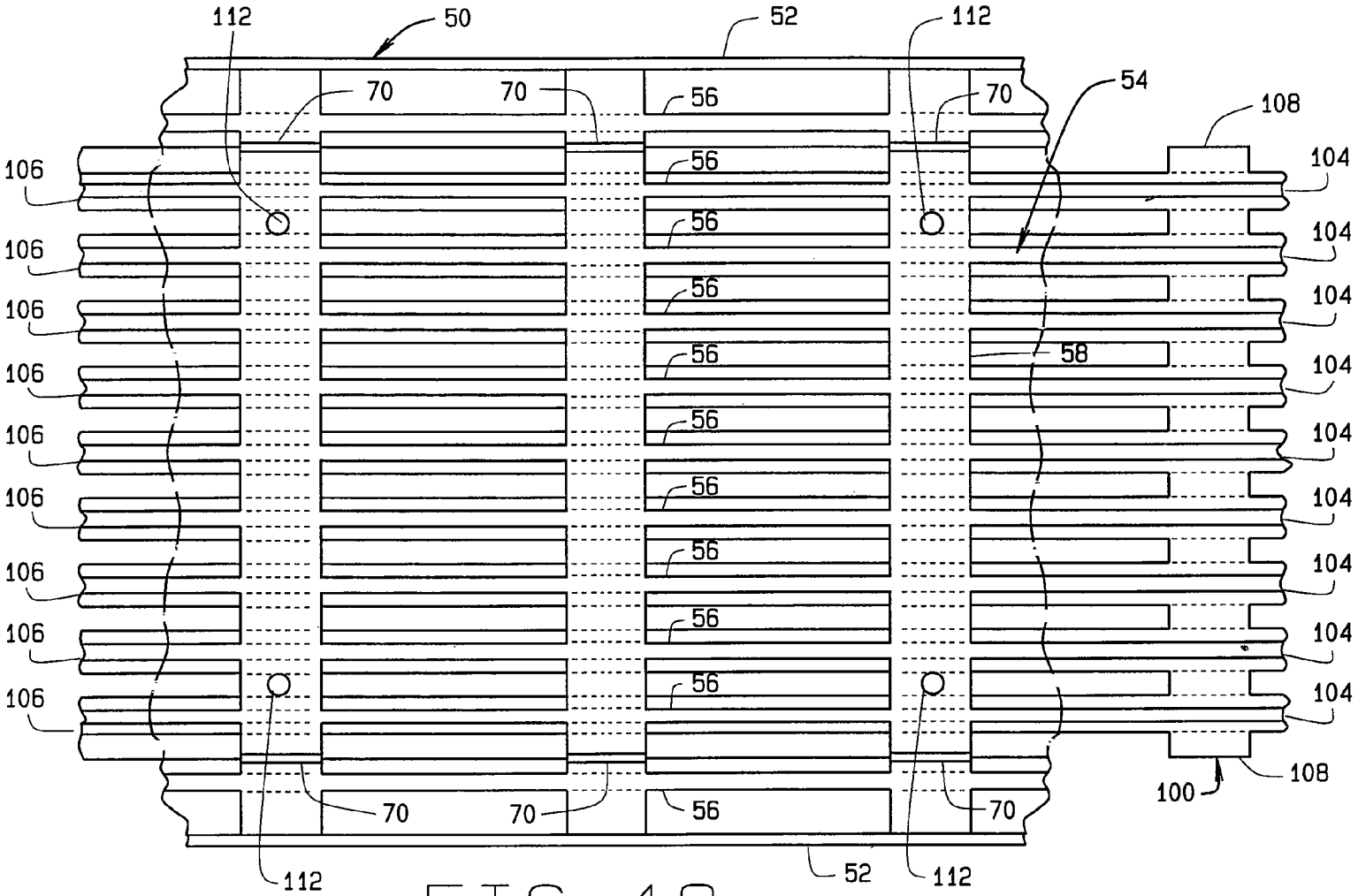
FIG. 18 is an enlarged, fragmentary bottom view of the dispenser and glide strip.

As clearly shown in FIGS. 13 and 14 the hooks 102 fit snugly under the lateral stringers or end lateral portions, including the front and rear floor portions 50, and are sized to underfit and engage said lateral stringers 58 and floor portions 60. These hooks, providing attachment of the glide strip 100, may alone provide attachment to the container dispensers. However, in order to ensure a secure attachment for the glide strip 100, said strip is sonic welded permanently to the container dispenser from the underside at several points, after the glide strip is hooked in place on the lateral stringers for example two points indicated by numerals 112 on each of two lateral stringers 58 as shown in FIG. 18. In the preferred embodiment the hook intermediate portions 108 are aligned with the lateral stringers 58. This arrangement is clearly shown in FIGS. 17 and 18.

Although the invention has been described by making detailed reference to two preferred embodiments, such detail is to be understood in an instructive, rather than in any restrictive sense many variations being possible within the scope of the claims hereunto appended.

The invention claimed is:

1. A gravity feed container dispenser comprising:

a rack including a plurality of rails extending along a longitudinal axis of the rack;

a container dispenser for dispensing product, including a channel shaped member having opposed sidewalls and a plurality of stringers extending along a longitudinal axis of the container dispenser, and lateral members providing a floor, the stringers having depending attachment means cooperating with the rack rails to hold the container dispenser in place on the rack in snap fitted relation;

a glide strip overlying the floor of the dispenser and having a plurality of stringers, the stringers of the glide strip extending along a longitudinal axis of the glide strip with each stringer overlying a respective one of the dispenser stringers and the glide strip having a plurality of lateral members each overlying a respective one of the lateral members of the dispenser, and including attachment means at each end of the glide strip engaging at least two of the lateral members of the dispenser, and the glide strip being permanently attached to the dispenser.

2. A gravity feed container dispenser as defined in claim 1 wherein the glide strip is permanently attached to the dispenser by a plurality of sonic fusion points provided on selected lateral members of the dispenser in aligned relation to their respective lateral members of the glide strip for fusion of the glide strip to said dispenser.

3. A gravity feed container dispenser as defined in claim 1 wherein the glide strip is laterally corrugated to overlie the longitudinal stringers of the dispenser.

4. A gravity feed container dispenser comprising:

a container dispenser for dispensing products, the dispenser having a plurality of stringers extending along a longitudinal axis of the dispenser and a plurality of lateral members arranged at spaced intervals along the length of the stringers;

a glide strip having a plurality of stringers, the stringers extending along a longitudinal axis of the glide strip with each stringer overlying a respective one of the container dispenser stringers but being fewer in number than the dispenser stringers and the glide strip having a plurality of lateral members, each of the lateral members of the glide strip overlies a respective one of the lateral members of the dispenser, and the glide strip having selected stringers provided with depending hook members to hook onto selected lateral members of the container dispenser to provide a temporary hook attachment to said selected lateral members, and at least two of said lateral members of the container dispenser being fused as by sonic welding onto their respective lateral members of the dispensing container to provide a permanent heat fusion of said at least two of said lateral members of the glide strip to said respective lateral members of the container dispenser.

5. A gravity feed container dispenser as defined in claim 4 wherein the container dispenser stringers are upwardly tapered and the stringers of the glide strip are laterally contoured to accommodate the container dispenser stringers.

6. A gravity feed container dispenser as defined in claim 4 wherein the container dispenser includes front and rear lateral portions and the selected stringers of the container dispenser having said hook members have said hook members provided proximate said front and rear lateral portions, respectively.

7. A gravity feed container as defined in claim 4 wherein lateral members of the container dispenser include intermediate lateral members and the selected stringers includes depending hook members are attached to said intermediate lateral stringers.

* * * * *